United States Patent [19]

Kobayashi

[11] Patent Number: 4,694,842

[45] Date of Patent: Sep. 22, 1987

[54] TEA-CONTAINING TOBACCO

[76] Inventor: Kouzou Kobayashi, 239-3 Miyanogicho, Chiga-shi, Japan, 281

[21] Appl. No.: 534,151

[22] Filed: Sep. 21, 1983

[51] Int. Cl.[4] ..... A24B 15/18; A24D 1/18

[52] U.S. Cl. ..... 131/359; 131/352

[58] Field of Search ..... 131/359, 352, 332, 369

[56] References Cited

U.S. PATENT DOCUMENTS 2,930,719 3/1960 Finberg ..... 131/359

OTHER PUBLICATIONS

Alien Property Custodian to Lande S.N. 261,049 Mar. 3, 1939.

*Primary Examiner*—V. Millin

[57] ABSTRACT

Ingredients and process for preparing a smoking product "Tea-Containing Tobacco" are disclosed. The product consists essentially of tobacco leaves, tea leaves, chrysanthemum flowers and Cnidii Rhizoma.

1 Claim, No Drawings

TEA-CONTAINING TOBACCO

BACKGROUND OF THE INVENTION

The present invention relates to a smoking product, Tea-containing Tobacco, essentially consisting of tobacco leaves, green tea leaves, chrysanthemum flower and Cnidii Rhizoma. It is said that nicotine contained in tobacco leaves may be harmful to ones health. Tobacco manufacturers have tried to reduce the amount of nicotine content in their products, which may be inhaled during smoking.

This invention is based on the knowledge that the limited quantity of nicotine has favorable effect for ones health, because a trace of nicotine inhaled through smoking stimulates parasympathtic nervous system, which regulate functions of internal organs.

The sympathetic nervous system acts under ones will, while the parasympathetic nervous system can not be controlled by ones will. When parasympathetic system is stimulated by inhalation of nicotine, the movement of heart becomes active, the blood vessels are constricted and stomach activities are promoted. Therefore, inhalation of nicotine by tobacco smoking makes people feel good and it is not desirable to eliminate nicotine from smoking products. Of course, nicotine volume inhaled by the smokers depends on their consumption of cigarettes or cigars.

Parasympathetic and sympathetic nervous systems have interrelating functions just like a tug of war. When one system functions actively, the other is inhibited, respectively. And it is often noted that parasympathetic nervous system is depressed under over-tension or diseases with the like. In such instance, a piece of smoking product containing nicotine will help to stimulate parasympathetic system and, consequently, to relax tension.

SUMMARY OF THE INVENTION

The object of the present invention is to provide a tobacco composition which has favorable effect on smokers' physiological system.

The proposed tobacco composition consists of tobacco leaves, green tea leaves, "dry chrysanthemum flower" and Cnidii Rhizoma. Typical mixing proportion is, 0.3 g tobacco leaves, 0.1 g green tea leaves, 0.1 g dry chrysanthemum flower and 0.2 g Cnidii Rhizoma, to make a piece of cigarette of 0.7 g, weight similar to widely marketed cigarettes.

The important ingredients of the tobacco composition are green tea leaves and dry chrysanthemum flower. Generally, 0.2 g green tea leaves is required to awake nervous system, because green tea is known medical herb and has caffeine. Also, 0.2 g of dry chrysanthemum flower is required to make the liver active, because dry chrysanthemum flower is medical herb and contains quercetin. 0.4 g of Cnidii Rhizoma is also required to increase blood in human body, because Cnidii Rhizoma is medical herb and its essence has medicative effect for increasing blood.

Various mixing proportions is available beside the above typical composition. For example, 0.5 g of tobacco leaves, 0.05 g green tea leaves, 0.05 g dry chrysanthemum flower and 0.1 g Cnidii Rhizoma. Therefore, to obtain desired level of medicative effect from the Tea-Containing Tobacco, the smokers should smoke two or three pieces according to their mixing proportion.

Through our experiences, particularly favorable results have been noted from the use of a mixture of tobacco leaves, green tea leaves, dry chrysanthemum flower and Cnidii Rhizoma. Caffeine in green tea leaves, quercetin in dry chrysanthemum flower amd essence of Cnidii Rhizoma are effectively assimilated as vapor in the smoke produced by burning tobacco to which green tea leaves, dry chrysanthemum flower and Cnidii Rhizoma have been added, and they have good effect for human body.

These substances, i.e. caffeine, quercetin and essence of Cniddi Rhizoma enter the organism of the smoker through the respiratory or digestive organs. These substances are not changed in their nature when burned along with tobacco leaves.

PROCESS FOR THE SMOKING PRODUCT

This invention can be enbodied into final products almost in the same manner as that employed in the manufacture of ordinary tobacco. In order to combine tobacco leaves with green tea leaves, dry chrysanthemum flower and Cnidii Rhizoma, we can proceed in various ways. We may for instance make corresponding additions to the tobacco in the form of fibrous material, powder, suspension, solution or emulsion. We may add green tea leaves, dry chrysanthemum flower and Cnidii Rhizoma in a form of solution, vapor or fibrous materials to the sauce with which the tobacco or tobacco product is treated in the casing or flavouring step, or into the tobacco product, for instance a cigarette, before or while the tobacco is filled into the paper or other envelope.

The general type of procedure is employed in manufacturing tobacco and cigarettes which include green tea leaves, dry chrysanthemum flower and Cnidii Rhizoma. The tobacco leaves, green tea leaves, dry chrysanthemum flower and Cnidii Rhizoma are subdivided into fibers of the proper size.

And the above mixture will be placed in a hollow rotating cylinder having tumbling vanes, and the mixture will be tumbled so as to secure a fibrous mixture. The mixture will, then be placed in drums and fermented and dried. The mixture wil now be ready for making into cigarettes.

It will be evident that thirteen modifications can be made without departing from the scope of the present invention.

Modifications will be;

1. A tobacco composition consisting of tobacco leaves, green tea leaves and dry chrysanthemum flower
2. Tobacco leaves, green tea leaves and Cnidii Rhizomas
3. Tobacco leaves, dry chrysanthemum flower and Cnidii Rhizoma
4. Green tea leaves, dry chrysanthemum flower and Cnidii Rhyzoma
5. Tobacco leaves and green tea leaves
6. Tobacco leaves and dry chrysanthemum flower
7. Tobacco leaves and dry chrysanthemum flower
8. Green tea leaves and dry chrysanthemum flower
9. Green tea leavces and Cnidii Rhizoma
10. Dry chrysanthemum flower and Cnidii Rhizoma
11. Green tea leaves only
12. Dry chrysanthemum flower only
13. Cnidii Rhizoma only

DESCRIPTION OF THE PREFERRED EMBODIMENT

A tobacco composition consiting of 0.3 g tobacco leaves, 0.1 g green tea leaves, 0.1 g dry chrysanthemum flower and 0.2 g Cnidii Rhizoma.

I claim:

1. A tobacco composition consisting of tobacco leaves, green tea leaves, dry chrysanthemum flower and Cnidii Rhizoma.

* * * * *